US008723747B2

(12) United States Patent
Rice, I

(10) Patent No.: US 8,723,747 B2
(45) Date of Patent: May 13, 2014

(54) POLARIZATION PHASE DEVICE AND A FEED ASSEMBLY USING THE SAME IN THE ANTENNA SYSTEM

(75) Inventor: Paul Stoddard Rice, I, Portsmouth, RI (US)

(73) Assignee: KVH Industries, Inc., Middletown, RI (US)

( * ) Notice: Subject to any disclaimer, the term of this patent is extended or adjusted under 35 U.S.C. 154(b) by 227 days.

(21) Appl. No.: 13/424,644

(22) Filed: Mar. 20, 2012

(65) Prior Publication Data

US 2013/0249754 A1 Sep. 26, 2013

(51) Int. Cl.
*H01Q 19/00* (2006.01)

(52) U.S. Cl.
USPC ..... 343/756; 343/835; 343/836; 343/781 CA

(58) Field of Classification Search
CPC ... H01Q 15/24; H01Q 15/242; H01Q 15/244; H01Q 15/248; H01Q 19/00; H01Q 19/10; H01Q 19/12
USPC ..... 343/756, 834, 835, 836, 840, 772, 776, 343/781 R, 781 P, 781 CA, 765
See application file for complete search history.

(56) References Cited

U.S. PATENT DOCUMENTS 3,569,870 A * 3/1971 Foldes ..... 333/21 R
4,353,041 A * 10/1982 Bryans et al. ..... 333/21 A
7,236,681 B2 * 6/2007 Moheb et al. ..... 385/147
8,497,810 B2 * 7/2013 Kits van Heyningen et al. ..... 343/781 CA
8,599,085 B2 * 12/2013 Buer et al. ..... 343/756
2011/0068988 A1 * 3/2011 Monte ..... 343/761
2012/0001816 A1 * 1/2012 Blaney ..... 343/765
2012/0229232 A1 * 9/2012 Mahon et al. ..... 333/21 A

OTHER PUBLICATIONS

Simmons, A.J., "Phase Shift by Periodic Loading of Waveguide and Its Application to Broad-band Circular Polarization", RIE Transactions—Microwave Theory and Techniques, vol. MTT-3, pp. 18-21, Dec. 1955.

Kitsuregawa, Takashi, "Advanced Technology in Satellite Communication Antennas, Electrical & Mechanical Design", Artech House, Inc., pp. 84-87, 1990.

* cited by examiner

*Primary Examiner* — Hoang V Nguyen
(74) *Attorney, Agent, or Firm* — Lowenstein Sandler LLP

(57) ABSTRACT

The present invention is a satellite antenna system having a motor driven mechanism configured to rotate a feed assembly. The feed assembly includes at least one inner feed tube and at least one outer feed tube. The satellite antenna system also includes an alignment driver coupled to the feed assembly and configured to instruct the motor driven mechanism to place the feed assembly at a pre-determined alignment position. The satellite antenna system further includes a polarization phase device positioned in one of the inner feed tube and the outer feed tube. The motor driven mechanism is further configured to rotate the polarization phase device.

25 Claims, 6 Drawing Sheets

POLARIZATION PHASE DEVICE AND A FEED ASSEMBLY USING THE SAME IN THE ANTENNA SYSTEM

FIELD OF THE INVENTION

Embodiments of the invention are generally related to the field of satellite communication and antenna systems, and more particularly to a polarization phase device and a feed assembly for using the polarization phase device in such systems.

BACKGROUND OF THE INVENTION

Satellite antenna systems receive signals from satellites orbiting the earth. These satellites are generally designed to transmit a signal at a particular band frequency and polarization. When a satellite antenna system receives a broadcasted satellite signal, the signal is amplified and then sent to a converter, e.g. a Low Noise Block converter (LNB). When placing a satellite antenna system in communication with a satellite, the satellite antenna system is adjusted to provide an unobstructed path between the antenna and the satellite. An antenna system can be optimized to receive signals at a predetermined band frequency and polarization. With the diversity of signals being broadcast from a variety of satellite communication providers, it is desirable to achieve a system capable of receiving from multiple satellites at different band frequencies and/or polarizations.

A satellite communications system may use a linearly polarized signal for the downlink to the antenna system. The polarization direction for the downlink signals is determined by the feed assembly on the satellite antenna. To ensure maximum coupling of the signals to and from the satellite, each terrestrial antenna may include provisions to adjust the polarization directions of the feed components to exactly match the polarization direction defined at the satellite. In the present antenna systems, a skew motor is utilized to move a rotating member in a feed assembly in order to adjust the polarization direction of the feed components and a separate skew motor is utilized to rotate the polarization elements. The two skew motors make the antenna system very bulky and heavy requiring for two separate mechanisms to provide for adjustment of the polarization directions and the rotation of the entire antenna.

Thus there is need in the art to provide an improved antenna system having the feed assembly which is compact and efficient and further allows for a single mechanism to control both the adjustment of the polarization directions and the rotation of the entire antenna.

SUMMARY OF THE INVENTION

Embodiments of the present invention provide a satellite antenna system having a motor driver mechanism configured to rotate a feed assembly. The feed assembly includes at least one inner feed tube and at least one outer feed tube. The satellite antenna system also includes an alignment driver coupled to the feed assembly and configured to instruct the motor driven mechanism to place the feed assembly at a pre-determined alignment position. The satellite antenna system further includes a polarization device positioned in one of the inner feed tube or the outer feed tube. The motor driven mechanism is further configured to rotate the polarization phase device.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1:
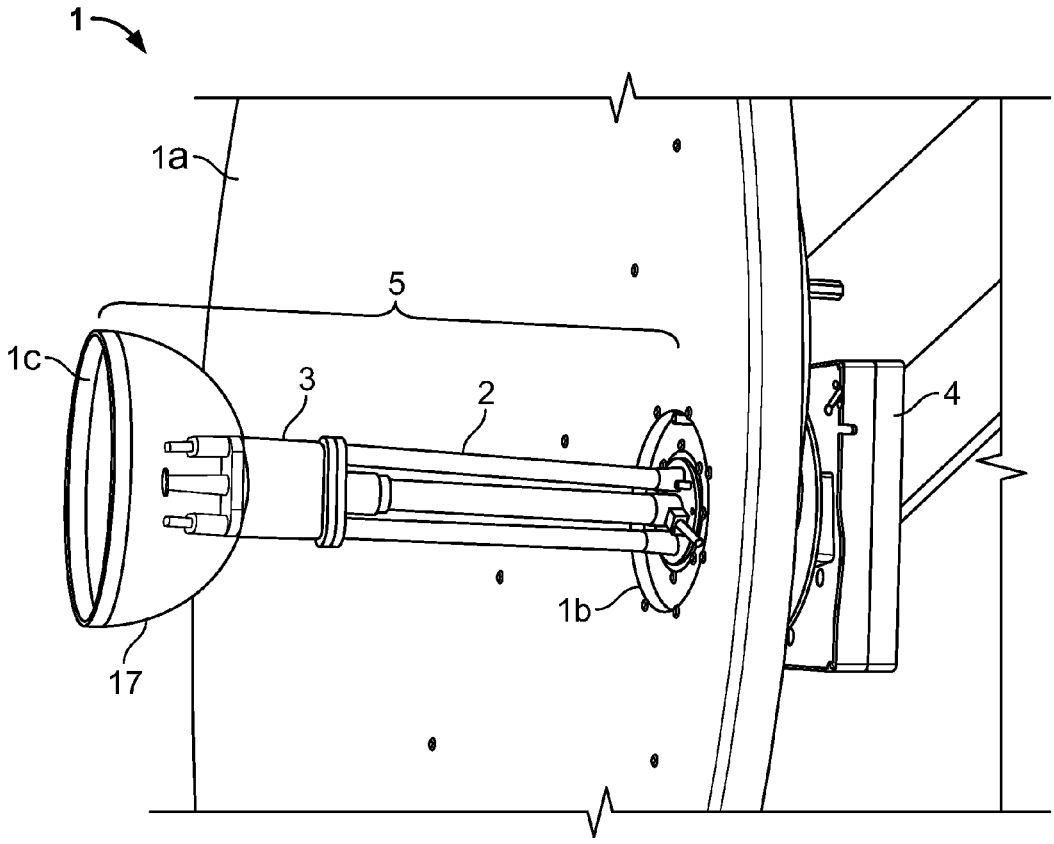
FIG. 1 depicts a schematic drawing of one embodiment of the antenna system including a feed assembly of the present invention.
Figure 1A:
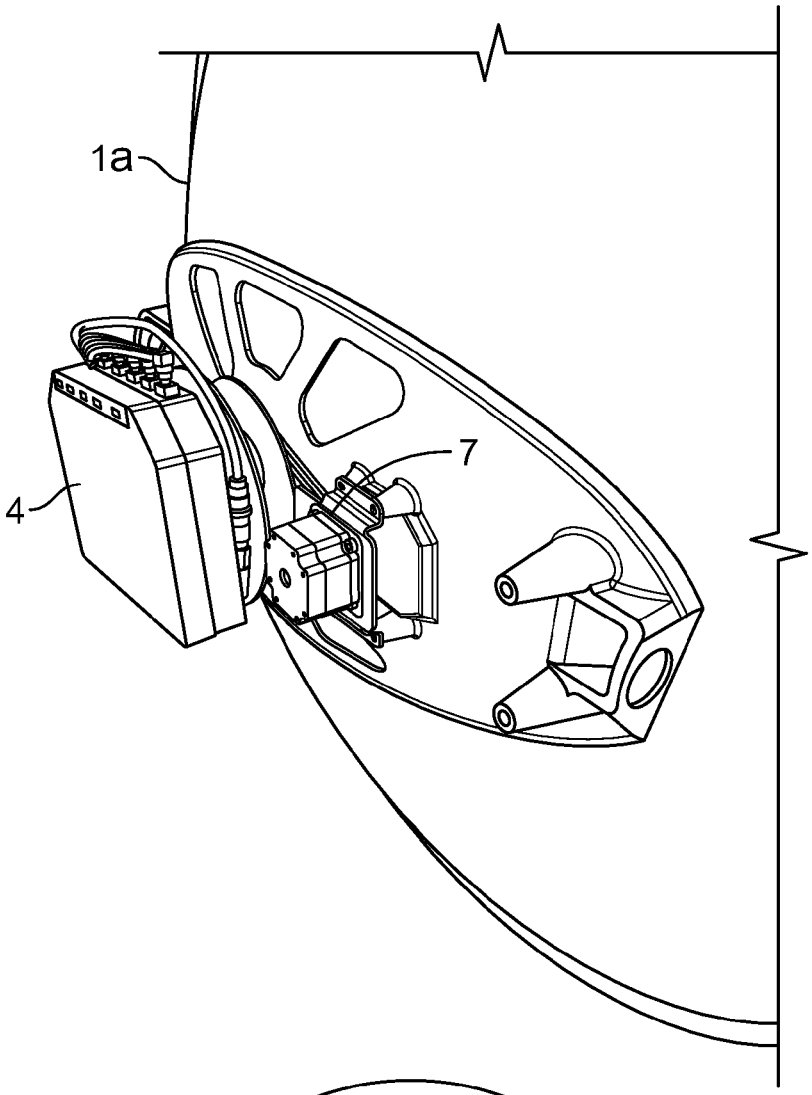
FIG. 1A depicts a schematic drawing of rear view of the antenna system including an LNB.
Figure 1B:
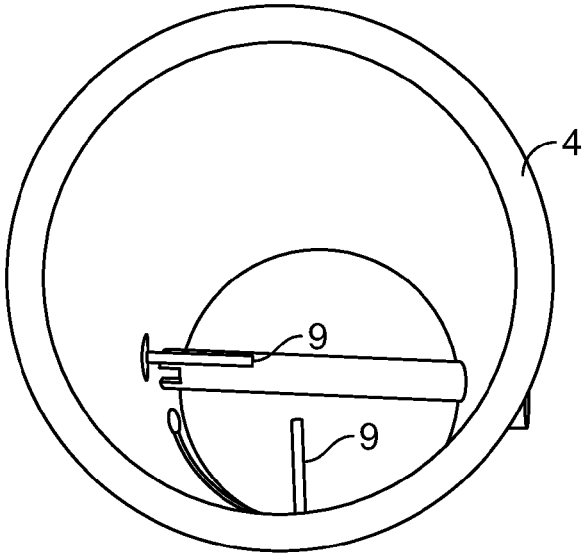
FIG. 1B depicts a schematic drawing of one embodiment of the LNB of FIG. 1A.

FIG. 1 illustrates one embodiment of a satellite antenna system (i.e. system) 1. The antenna system is preferably an axially symmetrical reflector system. The system 1 includes a primary reflector 1*a* having at least one opening 1*b*. The primary reflector 1*a* functions to receive and reflect the RF signals received from multiple satellites. In one embodiment, the primary reflector 1*a* may be a parabola-shaped reflector and is preferably made of metals such as aluminum or steel, however the other construction materials may be used, such as carbon fiber. The system 1 also includes a feed assembly 5 extending from the front to the rear of the primary reflector 1*a* via the at least one opening 1*b*. The system 1 also includes a low-noise block converter assembly (a.k.a. LNB) 4 affixed to one end of the feed assembly 5 at the rear of the primary reflector 1*a* as shown in FIG. 1A. In one embodiment the LNB 4 includes at least two pin probes 9 mounted orthogonal to each other as illustrated in FIG. 1B.

The feed assembly 5 includes a feed tube assembly 2 affixed to one end at the front of the primary reflector 1*a* and extending towards a sub-reflector 1*c* as shown in FIG. 1. The feed assembly 5 also includes a feed horn 3 affixed at one end at the rear of the sub-reflector 1*c*.

In one embodiment, the feed horn 3 includes a single aperture. In another embodiment, the feed horn 3 includes multiple apertures. The aperture is preferably a metal aperture designed with desired curvature shape to effectively collect the signal energy reflected back from the sub-reflector 1*c*. In one embodiment, dielectric rods 6 are incorporated into the feed horn 3 to further enhance the aperture efficiency and reduce the interference from adjacent feed apertures in the multiple aperture configurations. The collected signal propagates down the feed horn 3 towards the feed tube assembly 2 and the LNB 4 to be decoded by the receiver.

In one embodiment, the feed tube assembly 2 is positioned between the LNB 4 and the feed 6. In one embodiment, the feed tube assembly 2 includes one or more feed tubes. In one embodiment, the feed tube assembly 2 may include a Ka feed tube and Ku feed tube. In one embodiment, the feed tube assembly 2 includes a polarization phase device (not shown) as will be described in greater detail below.

The system also includes a skew motor 7 positioned behind the primary reflector 1*a* as shown in FIG. 1A. In one embodiment, the skew motor 7 is attached to the one end of the feed tube assembly 2 at the rear of the primary reflector 1*a* as shown in FIG. 1A. The skew motor 7 is a mechanical actuator operable to adjust various components of the system 1. For example, the skew motor 7 is a mechanical actuator which can rotate the feed assembly through 360°. In addition, the mechanical actuator may also function to rotate the polarization phase device to switch between linear and circular polarization modes which in turn switch the feed tube assembly 2 between linear polarization alignment position and circular polarization alignment position as will be described in greater detail below. In one embodiment, the skew motor 7 may perform each adjustment function simultaneously independent from each other.

The system 1 further includes at least a sub-reflector 1*c*, disposed to face towards the front of the primary reflector 1*a*. In one embodiment, the front surface of the sub-reflector 1*c* may include a reflecting surface facing the front surface of the primary reflector 1*a*. The sub-reflector 1*c* is made preferably of RF reflecting material such as, e.g., aluminum or steel. The sub-reflector 1*c* is a solid construction, i.e., the sub-reflector contains no openings, unlike the primary reflector. In order for the sub-reflector 1*c* to be in-plane and concentric with the primary reflector 1*a*, specific range of distance and/or angle are selected such that the sub-reflector images the satellite beam reflected from the surface of the primary reflector 1*a* onto an end of a feed horn 3. In one embodiment, this range of distance and/or angle depends on the shape and the size of both the primary 1*a* and the sub-reflector 1*c*. The sub-reflector 1*c* shares the same axis as the primary reflector 1*a* and thus the sub-reflector 1*c* is positioned to receive and reflect the RF signals directed from the primary reflector 1*a*. In one embodiment, a feed horn 3 arrangement of the feed assembly 5 in the primary reflector 1*a* allows variation of the shape of the sub-reflector 1*c* from the typical hyperbolic shape normally found in Cassegrain antennas. A modified hyperbolic shape of the sub-reflector allows for larger separation between the feed horns in the feed assembly. The sub reflector may be secured to the main-reflector preferably via a shaped dielectric support 17.

Figure 2:
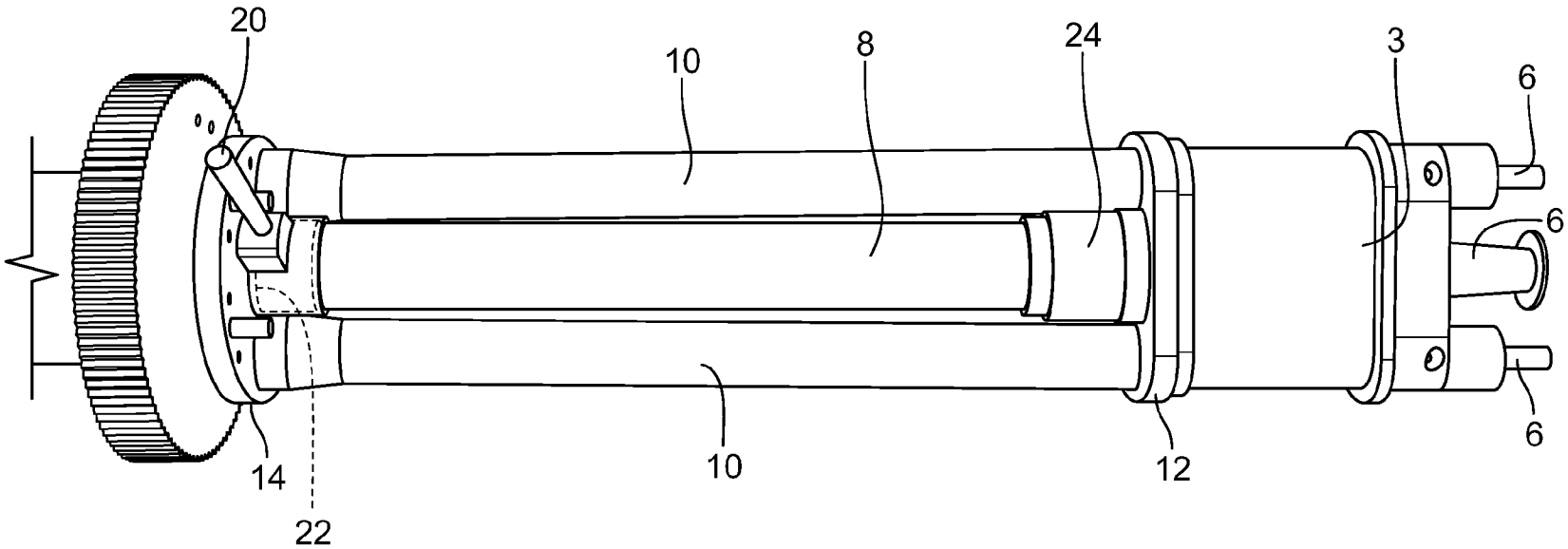
FIG. 2 depicts a schematic drawing of the feed assembly in accordance with an embodiment of the present invention.

FIG. 2 illustrates one embodiment of the feed assembly 5. In this embodiment, the feed assembly 5 may include a triple feed tube assembly 2 having an inner feed tube 8 and two outer feed tubes 10. In the embodiment shown in FIG. 2, the inner feed tube 8 includes a polarization phase device 30 (as illustrated in FIG. 3), which is rotatable and thus functions as a rotating polarization device. Although, not shown, in another embodiment, one of the outer feed tubes 10 may include the polarization phase device 30, which is rotatable and functions as a rotating polarization device. In one embodiment, the inner feed tube 8 is a Ku band feed tube and the two outer feed tubes 10 are Ka band feed tubes. Although not shown, in another embodiment, the feed tube assembly 2 may also include a double feed tube assembly having an inner feed tube and a single outer feed tube. Feed tubes/horns are preferably made of metals such as aluminum or steel, although they may also be metal coated plastic. The feed tubes may vary in shape and size. A first flange 12 and a second flange 14 may be disposed at the ends of the feed tube assembly 2. In one embodiment, the feed tube assembly 2 is a comprised of circular waveguides.

FIG. 3 illustrates a polarization phase device 30 in accordance with one embodiment of the present invention. In one embodiment, the polarization phase device 30 is sized and shaped to fit into one of the inner or outer or both feed tubes 8 and 10 respectively. In one embodiment, the polarization phase device 30 illustrated in FIG. 3 is shaped as an open clothespin having a length of 2 inches and width of 1 inch. In one embodiment, a polarizer is a 90 degree polarizer using a fused quartz plate and its performance as illustrated and described by Kitsuregawa, T, in "Advanced Technology in Satellite communications Antennas: electrical and Mechanical Design", *Artech House, Norwood, Mass*., pp. 85-86, FIG. 1.59, 1990. In another embodiment, a polarizer is made of metallic post as illustrated and described by A. J. Simmons in "Phase Shift by Periodic Loading of Waveguide and Its Application to Broadband Circular Polarization", *IRE Trans. Microwave Theory Tech*., Vol. MTT-3, No. 6, pp. 18-21 and FIG. 1.60(a), December 1955.

In one embodiment, the polarization phase device 30 functions as a phase shift device providing a phase shift of at least 45 degrees and is commonly used to convert a linearly polarized mode into or from a circularly polarized mode. In one embodiment, the polarization phase device 30 is made of a dielectric material such that RF travels along the surfaces and its shape and size and placement tends to delay the components within a RF wave which causes delay between the phases (sort of split the phases) of the RF wave that travel through it. In one embodiment, the polarization phase device 30 is a 90 degree polarizer which converts a circular polarized signal into a linear polarized signal. The linear polarized signal can be coupled into the signal probe in the LNB 4 with minimum polarization mismatch loss. A circular polarized wave can be decomposed into linear components which are parallel and perpendicular to a thin dielectric plate of the polarization phase device 30. The two linear components are equal in amplitude and 90 degree different in phase. The dielectric plate of the polarization phase device 30 delays the traveling wave, which is polarized along the plate, by 90 degree relative to the perpendicularly polarized wave. In essence, the dielectric material slows the wave relative to the same wave in air. So, the two linear components have the same phase after the circular polarized wave passes through the polarization phase device 30. Further, the two in-phase linear signals combines into a new linear signal with its polarization aligned with the probe in the LNB 4.

Figure 3A:
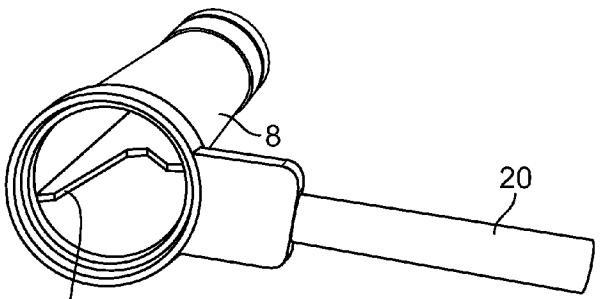
FIG. 3A depicts a schematic drawing of the polarization phase device with respect to the feed tube and alignment driver in accordance with the embodiment of the present invention.
Figure 3:
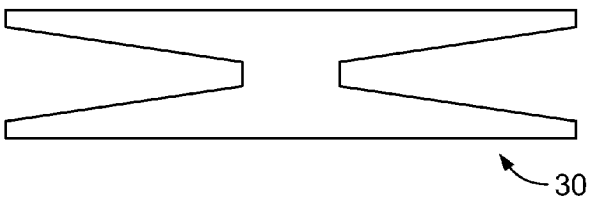
FIG. 3 depicts a schematic drawing of a polarization phase device in accordance with an embodiment of the present invention.

FIG. 3A illustrates a view of the polarization phase device 30 of FIG. 3 placed in the inner feed tube 8 in accordance with an embodiment of the present invention. As shown, the polarization phase device 30 extends into the inner feed tube 8 of the feed tube assembly 2. In one embodiment, the inner feed tube 8 with polarization phase device 30 is adapted to be rotatable about an axis of the inner feed tube 8 causing the inner feed tube 8 to rotate within the feed tube assembly 2 between pre-determined positions such as linear alignment position and circular alignment position as will be described in greater detail below.

Referring back to FIG. 1A, there is illustrated the LNB 4 with respect to the feed assembly 5 in accordance with an embodiment of the present invention. Specifically, the LNB 4 includes at least three LNBs 4*a*, 4*b* and 4*c*. In one embodiment, the LNBs 4*a* and 4*c* are Ka Band LNBs each of which are affixed to one end of each of the outer feed tubes 10. Similarly, the LNB 4*b* is a Ku Band LNB affixed to one end of the inner feed tube 8. As mentioned above, the LNB 4 includes at least two pin probes 9 mounted orthogonal to each other as illustrated in FIG. 1B. As such, each of the LNBs 4*a*, 4*b* and 4*c* include the at least two pin probes 9 mounted orthogonal to each other.

Figure 2A:
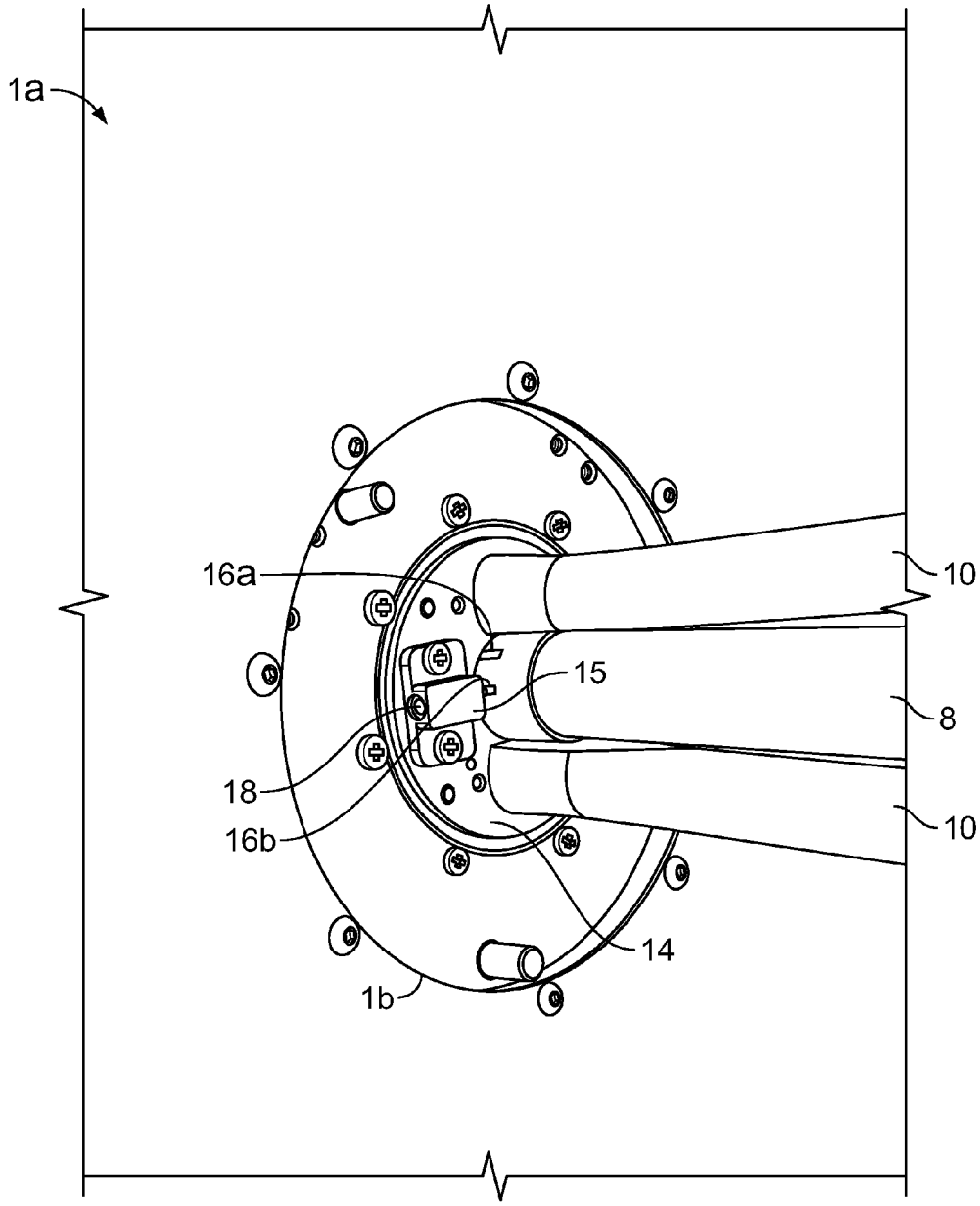
FIG. 2A depicts a schematic drawing of the circular polarization alignment position of the feed assembly of one embodiment of the feed assembly.

Referring to FIG. 2A, the feed tube assembly 2 includes a locking mechanism 15. In one embodiment, the locking mechanism 15 is incorporated to lock the polarization phase device 30 in a given mode. For example, the polarization phase device 30 may be locked between circular and linear mode as described in greater detail below.

In one embodiment, the locking mechanism 15 includes one or more detents 16 and a spring plunger 18. As shown in FIG. 2A, one or more detents 16 are coupled to the other end of the feed tube assembly 2 proximate to the second flange 14. In one embodiment, the feed tube assembly 2 has two detents 16*a* and 16*b* machined into it at a plane of the other end of the feed assembly 5 as shown in FIG. 2A. In one embodiment, a detent 16 may include a machined slot shaped and sized to receive an alignment driver as will be described in greater detail below.

In one embodiment, the detents 16 may be machined 45 degrees apart from each other. In one embodiment, each of the two detents 16 defines a pre-determined position and functions to place or locate the inner feed tube 8 with respect to the feed tube assembly 2. This in turn locks the inner feed tube 8 in the pre-determined position and thus allowing a control of the position of the inner feed tube 8 with respect to the rest of the feed assembly. In one embodiment, one of the detents 16 defines a linear polarization alignment position and other of the detents 16 defines a circular polarization alignment position. As shown in FIG. 2A, the spring plunger 18 is coupled to the one end of inner feed tube 8 proximate to the second flange 14. In one embodiment, the spring plunger 18 rotates in the same axis as the inner feed tube 8 and functions to prevent the inner feed tube 8 from rotation once the inner feed tube 8 is placed at one of the detents 16. As noted above, the inner feed tube 8 is positioned to be locked in one of the detents 16. However, due to motion caused by external forces, the inner feed tube 8 may tend to move from the locked position at one of the detents 16. In such situations, the spring plunger 18 applies force inside a slot to force the inner feed tube 8 to remain in the locked position. In one embodiment, a spring plunger 18 is comprised of a set screw with an internal spring fixed on one end and providing a force load on a ball (not shown) protruding beyond the body of the set screw. The loaded ball rides on a smooth outer diameter body of the inner feed tube 8 when the inner feed tube 8 is not at ends of rotational travel. When the inner feed tube 8 reaches the end of the rotational travel, the ball encounters a recessed feature (i.e. the detent 16) with enough force to hold the mechanism in place not allowing further rotation until the torque from the motor 7 forces the ball to retract.

The feed tube assembly 2 also includes the alignment driver 20 coupled to another end of the feed tube 8 proximate to the second flange 14 as show in FIG. 2. Specifically, the alignment driver 20 is a lever arm coupled to the end of the inner feed tube 8 containing the polarization phase device 30. The lever arm 20 functions to drive the inner feed tube 8 to rotate towards one of the detents 16 and remains placed/located in the detent 16 until the inner feed tube 8 begins to rotate towards other of the detents 16.

Figure 2B:
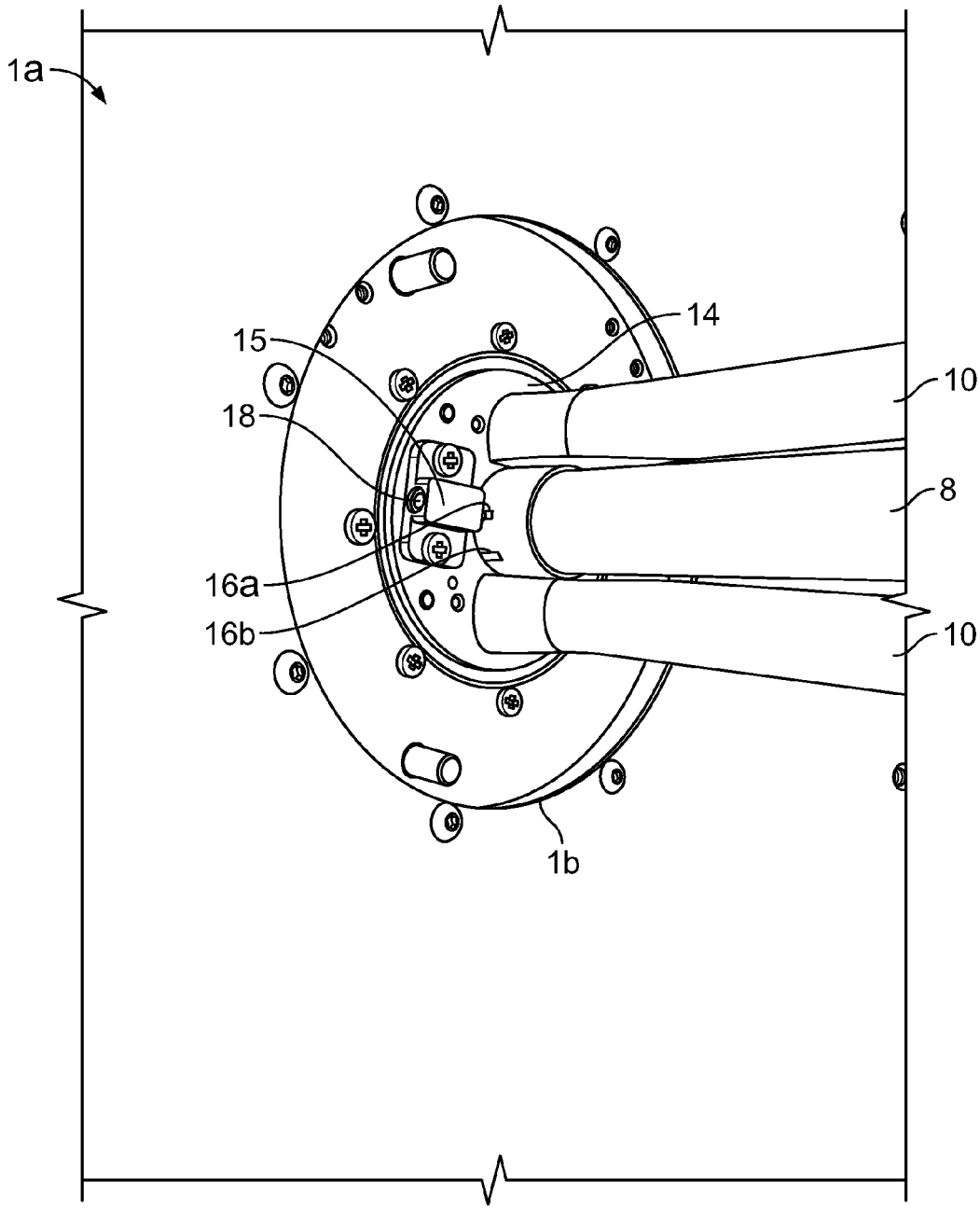
FIG. 2B depicts a schematic drawing of the linear polarization alignment position of the feed assembly of one embodiment of the feed assembly.

Referring to FIGS. 2A and 2B there is shown the linear polarization alignment position and the circular linear polarization alignment position respectively of the feed tube assembly 2 in accordance with an embodiment of the present invention. As discussed above, the polarization phase device 30 may be positioned within the inner feed tube 8 of the feed assembly 2. In one embodiment, when the inner feed tube 8 is rotated from the detent 16*a* to the detent 16*b*, the polarization phase device 30 is also rotated in a similar manner which drives the lever arm 20 towards the detent 16*b*. As soon as the lever arm 20 reaches the detent 16*b*, the feed assembly 2 is placed in the linear polarization alignment position as illustrated in FIG. 2A. Upon such position, the polarization phase device 30 is aligned with one of the two LNB pin probes of the LNB 4*b* and thus is in linear polarization mode with respect to one of the two probes of the LNB 4*b*. As a result, the LNB 4*b* receives linearly polarized satellite broadcast signals. In another embodiment, when the feed tube 8 is rotated from the detent 16*b* to the detent 16*a*, the polarization phase device 30 is similarly rotated which drives the lever arm 20 towards the detent 16*a*. As soon as the lever arm 20 reaches the detent 16*a*, the feed assembly 2 is located/placed in the circular polarization alignment position as illustrated in FIG. 2B. Upon such position, the polarization phase device 30 is 45 degrees out of position to each of the two pin probes of the LNB 4*b* and is in circular polarization mode with respect to the two pin probes of the LNB 4*b*. As a result, the LNB 4*b* receives circularly polarized satellite broadcast signals. This allows the polarization phase device 30 to change between a circular polarization mode and a linear polarization mode by rotating to a linear polarization alignment position and a circular polarization alignment position respectively. Thus, in one embodiment, one position of the polarization phase device 30 vertically bisects the feed tube assembly 2 in the linear polarization alignment position. In another embodiment, a second position of the polarization phase device 30 offsets the vertical bisection by 45 degrees in the circular polarization alignment position. It is noted that the feed tube assembly 2 is configured to switch from the circular polarization alignment position in FIG. 2B to the linear polarization alignment position in FIG. 2A.

Referring back to FIG. 2, the feed tube assembly 2 includes at least two plain bearings 24 and 22 disposed on each of the ends of the feed assembly 2 proximate the first flange 12 and the second flange 14 respectively. In one embodiment, the two plain bearings 22 and 24 contain and constraint the inner feed tube 8. In one embodiment, the two plain bearings 22 and 24 are cylindrical plain bearings which may include a bushing (not shown) made of or coated with polymer, graphic, ceramic or other material having a smooth and/or slippery surface. In one embodiment, the two plain bearings 22 and 24 function to allow the rotation of the inner feed tube 8 independent of rotation of the skew assembly. The plain bearing 24 is secured to the second flange 12 and with a slight gap between the inner surface of the plain bearing 24 and the outer diameter of the inner feed tube 8 in conjunction with the low coefficient of friction the bearing allows the inner feed tube 8 to rotate. In one embodiment, the plain bearings 22 and 24 are oil impregnated bronze that provides strength and lubrication.

Figure 2C:
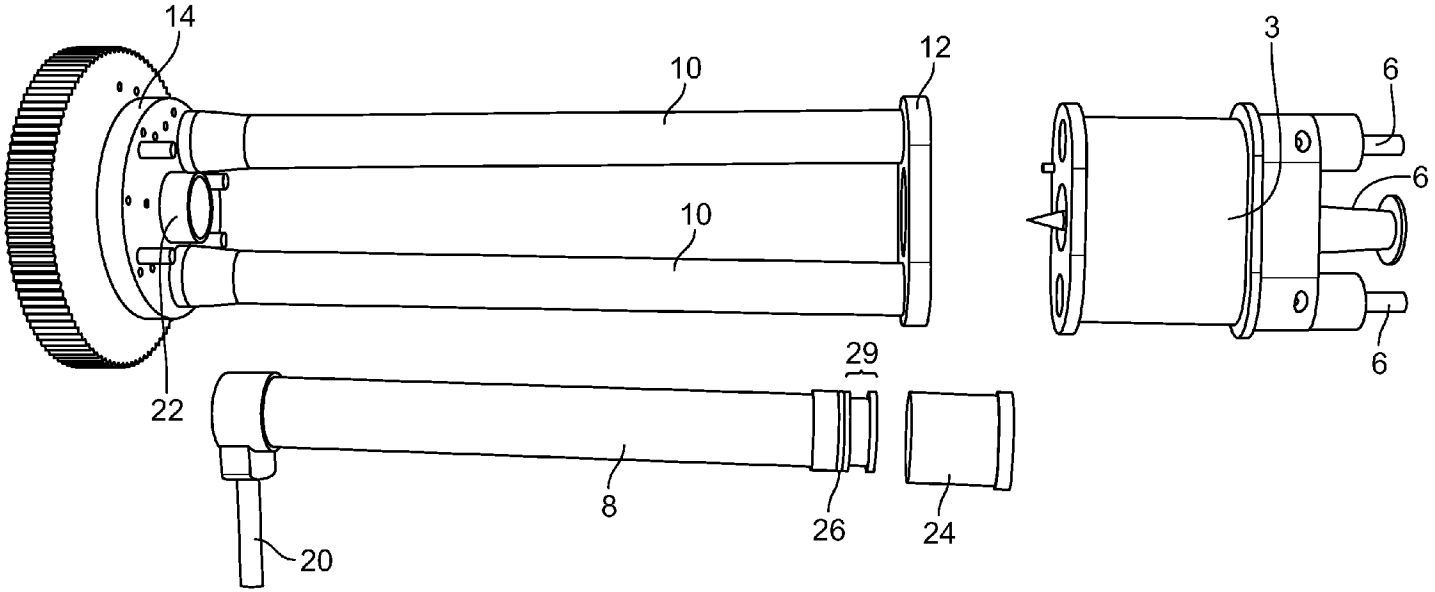
FIG. 2C depicts a schematic drawing of components of the feed assembly of FIG. 2 in accordance with an embodiment of the present invention.

Referring to FIG. 2C there is shown an enlarged view of the one end of the feed tube 8 proximate the first flange 12. Since manufacturing tolerances are addressed, the plain bearing 24 is designed to have a slight incline causing misalignment between the inner feed tube 8 and the plain bearing 24. The O-ring 26 functions to provide a seal and a spring to maintain relative alignment of the inner feed tube 8 and the plain bearing 24 during rotation. In one embodiment, the O-ring 26 is made of non-metallic materials. Since the O-ring 26 is not metal, a gap exists between the inner feed tube 8 and the plain bearing 24 which could allow escape of the RF energy from the inner feed tube 8. As such, an air choke 29 is implemented between the O-ring 26 and the plain bearing 24 to prevent the escape of the RF energy. Details of the air choke 29 which functions to prevent the escape the RF energy is provided in http://en.wikipedia.org/wiki/Waveguide_flange→Electrical Continuity→Choke connection. In one embodiment, the O-ring 26 and the air choke 29 are placed between the feed tube 8 and the plain bearing 24, so they are not visible upon completion of the feed assembly 2.

While the present invention has been described with respect to what are some embodiments of the invention, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A satellite antenna system, comprising:

a motor driven mechanism configured to rotate a feed assembly, the feed assembly comprising at least one inner feed tube and at least one outer feed tube;

an alignment driver coupled to the feed assembly, the alignment driver configured to instruct the motor driven mechanism to place the feed assembly at a predetermined alignment position; and a polarization phase device positioned in one of the feed tubes, wherein the motor driven mechanism is further configured to rotate the polarization phase device.

2. The system of claim 1 wherein the polarization phase device comprises dielectric material.

3. The system of claim 1 wherein the polarization phase device is shaped and sized to fit within one of the feed tubes.

4. The system of claim 1, wherein the polarization phase device extends into feed tube.

5. The system of claim 1, wherein the motor driven mechanism comprises a skew motor.

6. The system of claim 1 wherein the predetermined alignment position comprises one of a linear polarization alignment position and a circular polarization alignment position.

7. The system of claim 6, wherein the polarization phase device is configured to switch between linear polarization mode and circular polarization mode by rotating between the linear polarization alignment position and the circular polarization alignment position.

8. The system of claim 7, further comprising:

a locking mechanism coupled at one end of the feed assembly, wherein the locking mechanism is configured to lock the polarization phase device in one of the polarization modes.

9. The system of claim 8, wherein the locking mechanism comprises a pair of detents separated by a predetermined angle configured to locate the feed tube, wherein one of the detents defines the linear polarization alignment position and the other of the detents defines the circular polarization alignment position.

10. The system of claim 9 wherein the locking mechanism comprises a spring plunger configured to prevent the feed tube from rotation upon the locating of the feed tube in one of the detents.

11. The system of claim 9 wherein the alignment driver is configured to drive the feed tube between the detents.

12. The system of claim 9 further comprising a LNB receiver coupled to the one end of the feed assembly, wherein the LNB receiver comprises at least two pin probes.

13. The system of claim 12 wherein the polarization phase device is configured to align with one of the two pin probes of the LNB receiver in the linear polarization mode upon the location of the feed assembly in the linear polarization alignment position.

14. The system of claim 12 wherein the polarization phase device is configured to be positioned at a pre-determined angle to one of the two pin probes of the LNB receiver upon the location of the feed assembly in the circular polarization alignment position.

15. The system of claim 1 wherein the feed assembly comprises an air choke positioned between the feed assembly and the inner feed tube.

16. The system of claim 15 wherein the air choke is configured to limit escape of RF band signal from the feed assembly.

17. The system of claim 15 further comprising at least one bearing disposed at one end the feed assembly, wherein the bearing is configured to provide rotation to the feed tube.

18. The system of claim 1 wherein the inner feed tube is one of a Ku or Ka and the outer feed tube is other of the Ku or Ka feed horn.

19. The system of claim 1, wherein the feed assembly comprises a triple feed tube having one inner feed tube and two outer feed tubes.

20. The system of claim 19 wherein the inner feed tube comprises Ku and the two outer feed tubes comprise Ka.

21. The system of claim 19 wherein the inner feed tube is a Ka and the two outer feed tubes comprise Ku.

22. The system of claim 1 further comprising a primary reflector having a front portion and a rear portion and an opening between the front and the rear portion, wherein primary reflector is positioned to receive and reflect RF band signals at the front portion.

23. The system of claim 22 wherein the feed tube assembly extends from the front portion to the rear portion of the primary reflector via the opening.

24. The system of claim 22 wherein the motor driven mechanism is coupled to the feed assembly at the rear portion of the primary reflector.

25. The system of claim 22 further comprising a sub-reflector positioned to face the front portion of the primary reflector to receive and reflect the RF band signals directed by the primary reflector.

* * * * *